US006008490A

United States Patent [19]

Kato

[11] Patent Number: 6,008,490

[45] Date of Patent: Dec. 28, 1999

[54] METHOD AND APPARATUS FOR MEASURING AND ANALYZING MASS SPECTRUM

[75] Inventor: Yoshiaki Kato, Mito, Japan

[73] Assignee: Hitachi, Ltd., Tokyo, Japan

[21] Appl. No.: 09/048,347

[22] Filed: Mar. 26, 1998

[30] Foreign Application Priority Data

Mar. 31, 1997 [JP] Japan ..... 9-080207

[51] Int. Cl.[6] ..... H01J 49/00

[52] U.S. Cl. ..... 250/282

[58] Field of Search ..... 250/282

[56] References Cited

U.S. PATENT DOCUMENTS

| | | | |
|---|---|---|---|
| 4,144,451 | 3/1979 | Kambara | 250/281 |
| 4,769,540 | 9/1988 | Mitsui et al. | 250/288 |
| 5,072,115 | 12/1991 | Zhou | 250/282 |
| 5,103,093 | 4/1992 | Sakairi et al. | 250/288 |
| 5,247,175 | 9/1993 | Schoen et al. | 250/282 |
| 5,352,891 | 10/1994 | Monnig et al. | 250/282 |

OTHER PUBLICATIONS

Anal. Chem. 1989, 61, 1159–1164, Minoru Sakairi & Hideki Kambara: Atmospheric Pressure Spray Ionization for Liquid Chromatography/Mass Spectrometry, pp. 1159–1164.

Anal. Chem., vol. 62, No. 13, Jul. 1, 1990, Eric C. Huang et al.: Atmospheric Pressure Ionization Mass Spectrometry, pp. 713–725.

*Primary Examiner*—Jack I. Berman

*Attorney, Agent, or Firm*—Kenyon & Kenyon

[57] ABSTRACT

An analyzing portion searches a mass spectrum for a mass peak exceeding a threshold level and adds the mass corresponding to the searched peak to the mass differences listed in an adduct ion table stored in a table, thereby forming a quasi-mass spectrum. The analyzing portion compares the formed quasi-mass spectrum with a measured mass spectrum in terms of mass. If agreement in mass between both the spectra is found, an index S is incremented by one and finally a total value of the index S is calculated. The analyzing portion then searches for another mass peak exceeding the threshold level and executes a similar process. Resulting values of the indexes S are compared with each other and probabilities of m/z and adduct ions are output to a display portion. Emergence frequency is counted for each of detected ion types and stored in storage means. If the measurement is executed in a predetermined number of times, then a greater weight is allocated to the ion types having larger emergence frequency, followed by updating the adduct ion table stored in the table. That arrangement realizes a method and apparatus for measuring and analyzing a mass spectrum by which a quasi-molecular ion and hence the molecular weight of a sample can be quickly estimated with high accuracy while preventing an error from being mixed in the process of analysis.

14 Claims, 7 Drawing Sheets

METHOD AND APPARATUS FOR MEASURING AND ANALYZING MASS SPECTRUM

BACKGROUND OF THE PRESENT INVENTION

The present invention relates to a process for analyzing a mass spectrum obtained by a mass spectrometer, and more particularly to a method and apparatus for measuring and analyzing a mass spectrum which are optimum to determine a molecular ion and hence the molecular weight from a mass spectrum resulted under atmospheric pressure ionization.

Mass spectrometry is not only a measuring process with very high sensitivity, but also a superior analyzing process capable of providing the molecular weight and structural information of a sample. Also, an apparatus in which separating means, e.g., a gas chromatograph or liquid chromatograph, is provided as a preceding stage of a mass spectrometer to directly separate and analyze a mixture has been developed and widely used in recent years.

In general, a sample molecule introduced to a mass spectrometer is first ionized by an ion source, dispersed in a mass spectrometry section depending on its mass, and detected by a detector, thus providing a mass spectrum.

On that occasion, a resulting mass spectrum is usually represented in the form of a bar graph. In a bar graph, for example, a horizontal axis (X-axis) indicates a mass to charge ratio (m/z) of each ion and a vertical axis (Y-axis) indicates relative intensity of each ion that is normalized with the strongest mass peak as 100%.

A mass spectrum is made up of a molecular ion (having an m/z value of, for example, 200) resulted from ionization of a molecule itself, fragment ions (plural ions each having an m/z value of, for example, not larger than 200) resulted from a molecular ion being fragmented, an adduct ion (having an m/z value of, for example, larger than 200), and so on.

At the present, the Atmospheric Pressure Chemical Ionization (APCI) method, the Electro-Spray Ionization (ESI) method, etc. are employed in many cases. In both of those methods, because of soft ionization (meaning ionization that occurs with small energy), fragment ions are hard to be produced, while a quasi-molecular ion resulted from a proton or an alkali-metal ion (e.g., an $Na^+$ ion) being attached to a molecule is produced with high intensity. By using those methods, therefore, an unstable compound or the like can also be stably ionized.

In those atmospheric pressure ionization methods, because ionization takes place under the atmospheric pressure, the produced ion still exists under the atmospheric pressure after the ionization. The produced ion therefore repeatedly collides with neutral molecules (solvent molecules in many cases) in the surroundings. An ion produced under the atmospheric pressure is introduced to a chamber under vacuum for mass spectrometry. Upon being thus introduced to the vacuum chamber, the produced ion is quickly cooled owing to abrupt expansion (adiabatic expansion).

Once a solvent molecule which has been cooled similarly to a cooled ion collides with the ion, the solvent molecule can no longer detach from the ion and therefore an adduct ion including at lease one of many polar molecules (solvent molecules) attached thereto is created. The creation of such an adduct ion lowers the intensity of a molecule ion because an ion which should form a single mass peak (molecular ion) in its ideal condition is dispersed to a plurality of adduct ions.

As a result, the SN ratio of a molecule ion and hence the detection sensitivity of an apparatus are apparently reduced to a large extent. Also, a mass spectrum becomes complicated and the analyzing process is impeded by the emergence of an adduct ion. For this reason, commercially available LC/MS systems include means for dissociating adduct ions (by heating, activation upon collision of ions, and so on). Hence, the intensity of adduct ions is generally very small in mass spectra obtained by commercially available LC/MS systems.

Checking mass spectra in detail, however, those adduct ions sill have intensity at an observable level in many cases.

The attachment energy with which a polar molecule is attached to an ion is usually 1 eV or below that is much smaller than the bond energy of a chemical bond (such as a C —C or C—H bond) constituting an ion.

Accordingly, when a molecular ion is subject to excessive energy (heating, acceleration or collision of the ion, etc.) enough to produce fragment ions, a molecule attached to the molecular ion is first dissociated. After that, a covalent bond is disconnected to produce fragment ions. Therefore, an adduct ion made up of a fragment ion and a polar ion attached to it does not exist usually.

Because of soft ionization, the atmospheric pressure ionization gives a simple mass spectrum in which fragment ions are few and a quasi-molecular ion (protonated ion) is emphasized. Conversely, simplicity of a mass spectrum is often not enough to provide a conclusive factor in determining the molecular weight.

In the Electron Ionization (EI) method which produces many fragment ions, mass differences between an ion estimated to be a molecular ion and a plurality of fragment ions are determined, and the molecular ion is estimated without including contradictions in comparison with the process where fragments are created (called fragmentation). As more fragment ions can be explained without including contradictions, the more exact is the estimation.

However, mass spectra obtained by LC/MS systems are generally very simple in many cases. In such a mass spectrum, it is difficult to immediately judge whether the produced ion is a quasi-molecular ion, or a fragment ion resulted from the quasi-molecular ion being fragmented, or an adduct ion having a solvent molecule attached thereto. To estimate the quasi-molecular ion, therefore, its molecular weight must be estimated through a complicated try-and-error process below.

Specifically, first, the strongest mass peak in a high molecular region of a resulting mass spectrum is assumed to represent a quasi-molecular ion. Then, mass differences between the assumed quasi-molecular ion corresponding to the strongest mass peak and ions around the strongest mass peak are determined. After that, the mass differences are checked one by one on whether it agrees with the molecular weight of any of solvent molecules and an ammonium ion. If agreement is found, it is judged that the assumed quasi-molecular ion is possibly an adduct ion.

Next, by assuming another mass peak to represent a quasi-molecular ion, the quasi-molecular ion is estimated through a similar process as mentioned above. As a result of such repeated try-and-error processes, one of the assumed quasi-molecular ions which accompanies minimum contradictions is estimated to be a quasi-molecular ion of target.

However, the above estimate analysis is made by a man such as a person in charge of analysis and a process of the estimate analysis is merely a repetition of try-and-error operations. This means that an incorrect prediction tends to easily mix in the estimation or assumption, and that a missing or misunderstanding is more likely to occur as a matter of course. Eventually, a possibility of mistakes or overlooks becomes very high. Also, a lot of time and labor are required.

A possibility as to whether an adduct ion or the like emerges or not greatly depends on physicochemical properties of a compound, LC analyzing conditions (such as the kind, pH, flow rate and temperature of an eluent), measuring conditions of an LC/MS system (such as the ionization method, i.e., ESI or APCI, and the voltage, temperature and pressure of an interface), etc. The analysis of a mass spectrum must be made in consideration of those preconditions as well.

Accordingly, the analysis of a mass spectrum of unknown components requires a high level of knowledge and long experiences. Since a person in charge of measurement and a person in charge of analysis are generally different from each other in many cases, it is unavoidable that all the analyzing conditions are not exactly informed from the person in charge of measurement to the person in charge of analysis, and therefore an error is brought into the process of analysis.

Further, when a plurality of components are eluted from an LC in overlapped relation, or when a sample to be measured is a mixture, a mass spectrum is given by a combination of spectra corresponding to those plural components or several ingredients of the mixture. In such a case, a resulting mass spectrum is so complicated that it is difficult for even an experienced person to analyze the mass spectrum.

In the measurement using an LC/MS system, the system is usually operated to provide mass spectra not less than 1000 per day. Analysis of mass spectra in such a large number requires a lot of time and labor; hence a longer time than necessary for the measurement must be taken for the analysis. Accordingly, an error is more likely to occur in the process of analysis as a matter of course. This has been a big obstacle in improving the efficiency of qualitative analysis using LC/MS systems.

SUMMARY OF THE INVENTION

With a view of solving the above-mentioned problems in the art, an object of the present invention is to provide an improved mass spectrometry system. More particularly, the present invention is to provide a method and apparatus for measuring and analyzing a mass spectrum by which a quasi-molecular ion and hence the molecular weight of a sample can be quickly estimated with high accuracy while preventing an error from being mixed in the process of analysis.

Preferably, the method of measuring and analyzing a mass spectrum comprises the steps of determining mass differences between a particular peak and a plurality of other peaks, determining an index value by comparing the mass differences with values stored in a storage table, determining mass differences between another peak different from the particular peak and a plurality of peaks different from the another peak, determining an index value by comparing the mass differences with the values stored in the storage table, and selecting particular one of the plurality of peaks by comparing the index values determined respective for the plurality of peaks with each other.

Also, to achieve the above object, the present invention provides a method of measuring and analyzing a mass spectrum in which an ion is created under the atmospheric pressure or thereabout, the created ion is introduced for mass spectrometry, and a resulting mass spectrum is processed and analyzed, the method comprising the steps of determining an index indicating how many times mass differences between the mass selected from the resulting mass spectrum and other masses agree with plural mass differences between a quasi-molecular ion and a plurality of adduct ion types stored in adduct ion storage means beforehand, and estimating, based on index values determined for respective selected masses, the ion providing a maximum value of the index indicating agreement of the mass difference as a quasi-molecular ion.

The above feature enables a molecular ion to be automatically estimated, and hence realizes a method of measuring and analyzing a mass spectrum by which a quasi-molecular ion and hence the molecular weight of a sample can be quickly estimated with high accuracy while preventing an error from being mixed in the process of analysis.

Preferably, the mass spectrum measuring/analyzing method further comprises the steps of storing adduct ions associated with the estimated quasi-molecular ion for each cycle of mass spectrometry, determining emergence frequency for each of the stored adduct ions after repeating the mass spectrometry in a predetermined number of times, allocating weights to the plurality of adduct ion types depending on respective determined emergence frequencies, storing the weights in the adduct ion storage means, and adding the stored weights to the index values in the step of estimating a quasi-molecular ion.

Thus, the ion types having high emergence frequency are automatically weighted and stored in the adduct ion storage means. Accordingly, the accuracy of mass spectrometry for the objects which are analyzed in many times by individual mass spectrum measuring/analyzing apparatus can be improved.

Preferably, the resulting mass spectrum is a mass spectrum obtained by subtracting a background spectrum given as a mass spectrum in the region where a component to be analyzed does not appear from a mass spectrum resulted by mass spectrometry.

Preferably, the adduct ion storage means stores plural mass differences between a quasi-molecular ion and a plurality of adduct ion types in a plurality of storage tables divided in accordance with the kind of solvent used in mass spectrometry, the ionization mode and the polarity of spectrum, and suitable one of the storage tables is selected depending on analyzing conditions of the mass spectrometry.

Since a suitable storage table is selected depending on analyzing conditions of the mass spectrometry, a quasi-molecular ion can be estimated in an optimum way depending on the analyzing conditions.

Preferably, the resulting mass spectrum is a mass spectrum obtained by correcting a contribution of $^{13}C$ on a mass spectrum resulted by mass spectrometry.

Preferably, the mass spectrum is represented in the form of a bar graph, and bars of the bar graph corresponding to mass peaks estimated to be representative of a quasi-molecular ion and associated adduct ions are indicated in clearly different width or color from other bars of the bar graph corresponding to mass peaks other than the estimated mass peaks.

Since a bar of the bar graph corresponding to the mass peak estimated to be representative of a quasi-molecular ion is indicated wider than or in different color from bars corresponding to other mass peaks, the quasi-molecular ion can be more clearly indicated.

Further, the present invention provides an apparatus for measuring and analyzing a mass spectrum, comprising means for creating an ion under the atmospheric pressure or thereabout, a mass spectrometer to which the created ion is introduced for mass spectrometry, and data precessing means for processing and analyzing a mass spectrum output from the mass spectrometer, the data precessing means comprising adduct ion storage means for storing plural mass differences between a quasi-molecular ion and a plurality of adduct ion types, and an analyzing portion for determining an index indicating how many times mass differences between the mass selected from the output mass spectrum and other masses agree with the plural mass differences stored in the adduct ion storage means, and estimating, based on index values determined for respective selected masses, the ion providing a maximum value of the index indicating agreement of the mass difference as a quasi-molecular ion.

The above feature enables a molecular ion to be automatically estimated, and hence realizes an apparatus for measuring and analyzing a mass spectrum by which a quasi-molecular ion and hence the molecular weight of a sample can be quickly estimated with high accuracy while preventing an error from being mixed in the process of analysis.

Preferably, the analyzing portion stores adduct ions associated with the estimated quasi-molecular ion for each cycle of mass spectrometry, determines emergence frequency for each of the stored adduct ions after repeating the mass spectrometry in a predetermined number of times, allocates weights to the plurality of adduct ion types depending on respective determined emergence frequencies, stores the weights in the adduct ion storage means, and adds the stored weights to the index values in estimating a quasi-molecular ion.

Thus, the ion types having high emergence frequency are automatically weighted and stored in the adduct ion storage means. Accordingly, the accuracy of mass spectrometry for the objects which are analyzed in many times by individual mass spectrum measuring/analyzing apparatus can be improved.

Preferably, the data processing means subtracts a background spectrum given as a mass spectrum in the region where a component to be analyzed does not appear from the mass spectrum output from the mass spectrometer, and the analyzing portion estimates a quasi-molecular ion based on a mass spectrum resulted from the subtraction.

Preferably, the adduct ion storage means stores plural mass differences between a quasi-molecular ion and a plurality of adduct ion types in a plurality of storage tables divided in accordance with the kind of solvent used in mass spectrometry, the ionization mode and the polarity of spectrum, and the analyzing portion selects suitable one of the storage tables depending on analyzing conditions of the mass spectrometry.

Since a suitable storage table is selected depending on analyzing conditions of the mass spectrometry, a quasi-molecular ion can be estimated in an optimum way depending on the analyzing conditions.

Preferably, the data processing means corrects a contribution of $^{13}C$ on the mass spectrum output from the mass spectrometer, and the analyzing portion estimates a quasi-molecular ion based on a corrected mass spectrum.

Preferably, the data processing means further comprises a data display portion, the data display portion representing the mass spectrum in the form of a bar graph such that bars of the bar graph corresponding to mass peaks estimated to be representative of a quasi-molecular ion and associated adduct ions are indicated in clearly different width or color from other bars of the bar graph corresponding to mass peaks other than the estimated mass peaks.

Since a bar of the bar graph corresponding to the mass peak estimated to be representative of a quasi-molecular ion is indicated wider than or in different color from bars corresponding to other mass peaks, the quasi-molecular ion can be more clearly indicated.

DESCRIPTION OF THE PREFERRED EMBODIMENT

Figure 9:
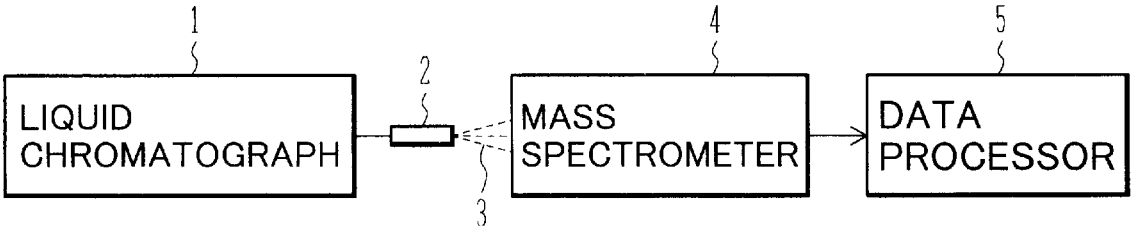
FIG. 9 is a block diagram of a mass spectrum measuring/analyzing apparatus comprising a liquid chromatograph and a mass spectrometer directly coupled to it.

First, an outline of a mass spectrum measuring/analyzing apparatus comprising will be described with reference to FIG. 9. Shown is an LC/MS system comprising a liquid chromatograph and a mass spectrometer directly coupled to it, which has recently become popular and in which a liquid chromatograph (LC) 1 as separating means is coupled to a mass spectrometer 4 and ionization is carried out under the atmospheric pressure. Atmospheric pressure chemical ionization methods which have received most popularity in such an LC/MC system are the Electro-Spray Ionization (ESI) method and the Atmospheric Pressure Chemical Ionization (APCI) method.

In the ESI method, an eluent from the LC 1 is introduced to a nozzle (ESI probe) 2 to which a high voltage is applied, and the introduced eluent is nebulized into a high electric field from the nozzle 2, thereby producing droplets with charges. The droplets collide with atmosphere molecules, etc. for formation of a finer mist and drying thereof, whereupon ions 3 are created.

On the other hand, in the APCI method, a sample molecule is ionized based on an ion molecular reaction. To this end, a needle to which a high voltage is applied is disposed downstream of the nebulized droplets. A corona discharge generated by the needle first ionizes solvent molecules which are present in a large number. Solvent ions further collide with surrounding molecules and finally ionize sample molecules. The resulting ions are dispersed depending on mass and detected by the mass spectrometer 4, following by a data processor 5 providing a mass spectrum.

Figure 3:
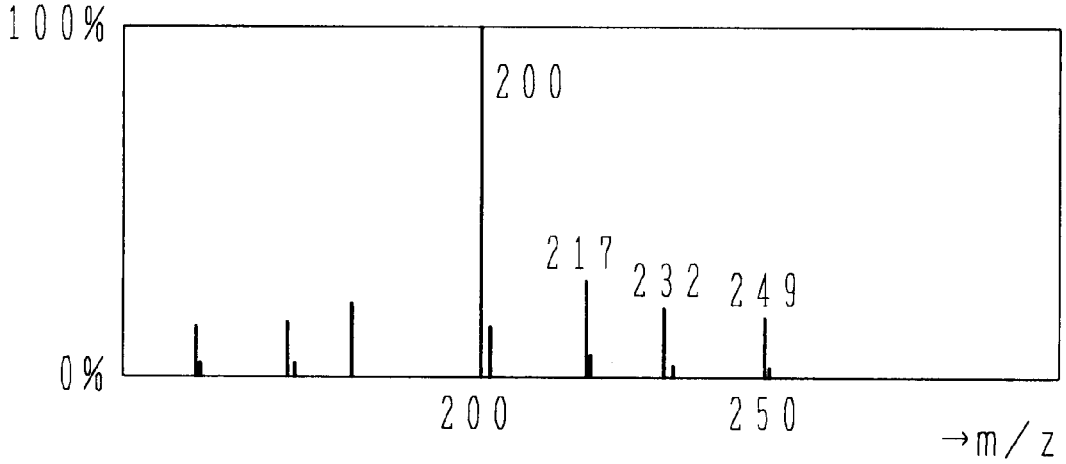
FIG. 3 is a graph showing a mass spectrum obtained with the atmospheric pressure ionization.
Figure 10:
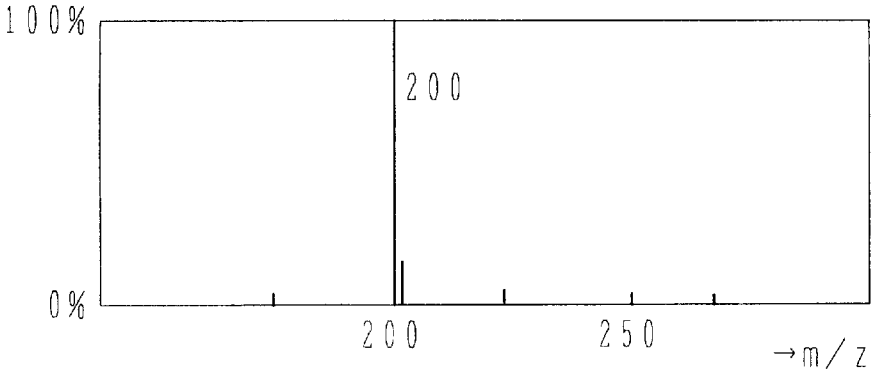
FIG. 10 is a graph showing one example of a mass spectrum obtained with the atmospheric pressure ionization.

One example of a mass spectrum will now be described with reference to FIG. 3. A resulting mass spectrum is represented in the form of a bar graph as shown in FIG. 3. In the bar graph of FIG. 3, a horizontal axis (X-axis) indicates a mass to charge ratio (m/z) of each ion and a vertical axis (Y-axis) indicates relative intensity of each ion that is normalized with the strongest mass peak as 100%. Incidentally, because of soft ionization, the atmospheric pressure ionization provides a simple mass spectrum in which fragment ions are few and a quasi-molecular ion (protonated ion) is emphasized, as shown in FIG. 10.

A mass spectrum is made up of a molecular ion (having an m/z value of 200 in the example of FIG. 3) resulted from ionization of a molecule itself, fragment ions (plural ions each having an m/z value of not larger than 200 in the example of FIG. 3) resulted from a molecular ion being fragmented, an adduct ion (having an m/z value of larger than 200 in the example of FIG. 3), and so on.

Figure 1:
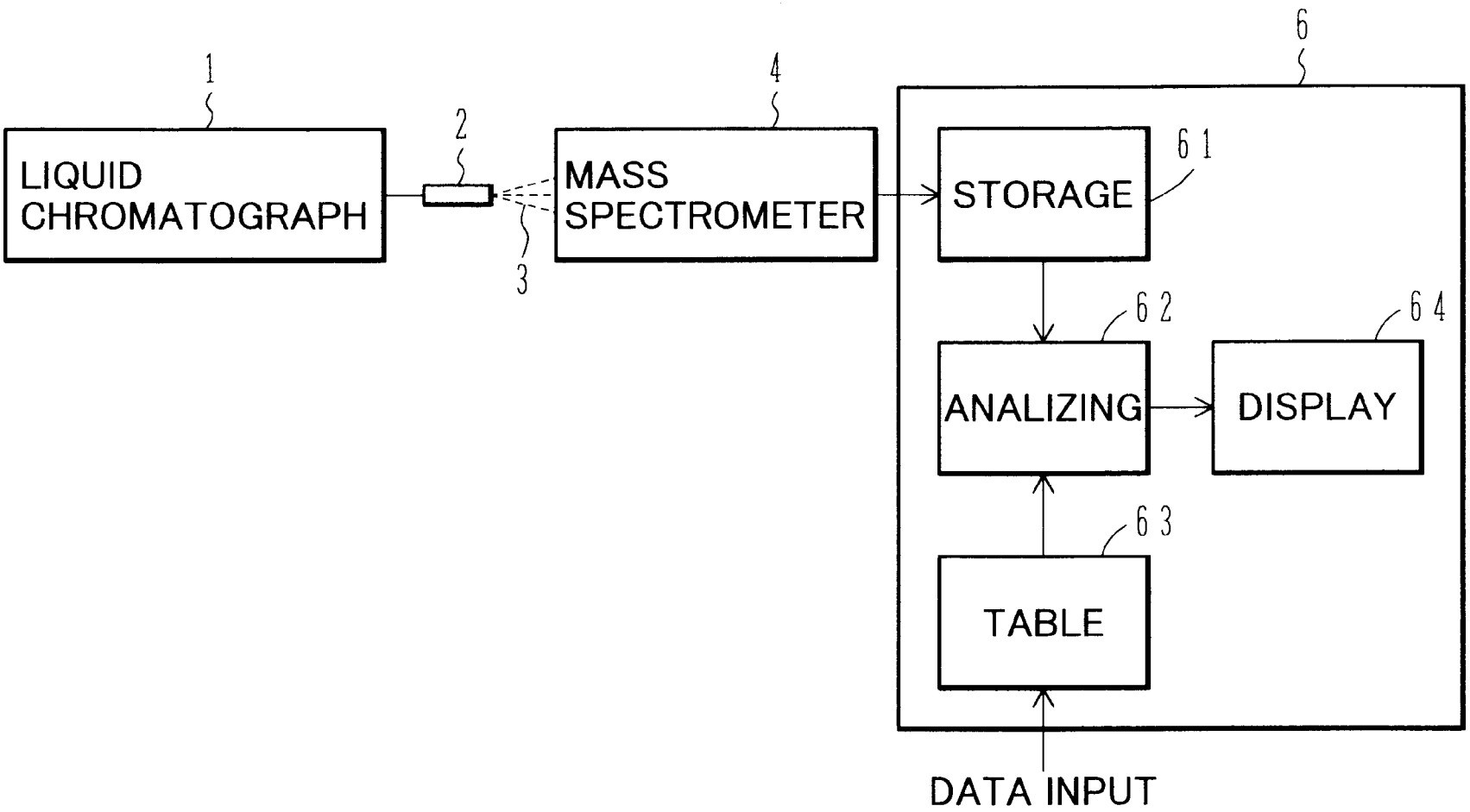
FIG. 1 is a block diagram of a mass spectrum measuring/analyzing apparatus for implementing a mass spectrum measuring/analyzing method according to a first embodiment of the present invention.

FIG. 1 is a block diagram of a mass spectrum measuring/analyzing apparatus for implementing a mass spectrum measuring/analyzing method according to a first embodiment of the present invention. In this embodiment, the invention is applied to a liquid chromatograph (LC). Equivalent components to those shown in FIG. 9 are denoted by the same reference numerals.

In FIG. 1, a mass spectrum of a sample measured by a mass spectrometer 4 is input to and stored in a mass spectrum storage portion 61 of a data processor 6. The mass spectrum stored in the mass spectrum storage portion 61 is analyzed by a analyzing portion 62 to estimate a quasi-molecular ion while referring to an adduct ion table (adduct ion storage means), described later, stored in the form of a table 63. Results estimated and analyzed by the analyzing portion 62 are indicated by a display portion 64 in the form of a bar graph or the like.

An adduct ion table shown in Table 1 lists adduct ions which often emerge in analysis using the atmospheric pressure chemical ionization method. Note that the adduct ion table of Table 1 and other adduct ion tables described below have been obtained from experiments made by the inventors of this application. In the following adduct ion tables, a dehydration peak resulted from dissociation of a water molecule from an protonated ion is additionally included in each table because it also serves as a conclusive factor in estimating a quasi-molecular ion.

TABLE 1

| Mass Diff. | Ion Type | |
|---|---|---|
| −18 | dehydration peak | fragment ion |
| 0 | protonated ion | (M + 1) quasi-molecular ion |
| +17 | ammonium ion adduct ion | (M + $NH_4$) |
| +32 | methanol adduct ion | |
| +41 | acetonitril adduct ion | |
| +49 | ammonia + methanol adduct | |
| +58 | ammonia + acetonitril adduct | |
| +60 | acetic acid adduct ion | |
| +77 | ammonium acetate adduct | |

In Table 1, as with the protanated ion $(M+H)^+$, the ammonium ion adduct ion $(M+NH_4)^+$ can be said as one of quasi-molecular ions. The other ions are produced as a result of that neutral solvent ions, etc. are further attached to those quasi-molecular ions. Unlike the ESI method, the APCI method does not generally produce ions to which alkali-metal ions (such as Na and K ions) are attached.

An adduct ion table shown as Table 2 below lists quasi-molecular ions and adduct ions emerging in ESI spectra.

TABLE 2

| Mass Difference | Ion Type |
|---|---|
| −18 | dehydration peak |
| 0 | protonated adduct |
| +17 | ammonium ion adduct ion |
| +22 | +Na |
| +32 | methanol ion |
| +39 | +K |
| +41 | acetonitril adduct |
| +49 | ammonia + methanol |
| +54 | +Na + methanol |
| +58 | ammonia + methanol |
| +60 | acetic acid adduct |
| +63 | +Na + acetonitril |
| +70 | +K + methanol |
| +77 | ammonium acetate adduct |
| +79 | +K + acetonitril |

Of the ions listed in Table 2, in addition to the protonated ion, $(M+Na)^+$ and $(M+K)^+$ ions including alkali-metal ions attached thereto are often observed. As with the APCI method, there also often emerge ions which are resulted from solvent ions being further attached to those ions.

Any of the above adduct ion tables can be input to the table 63 with external input means.

Figure 2:
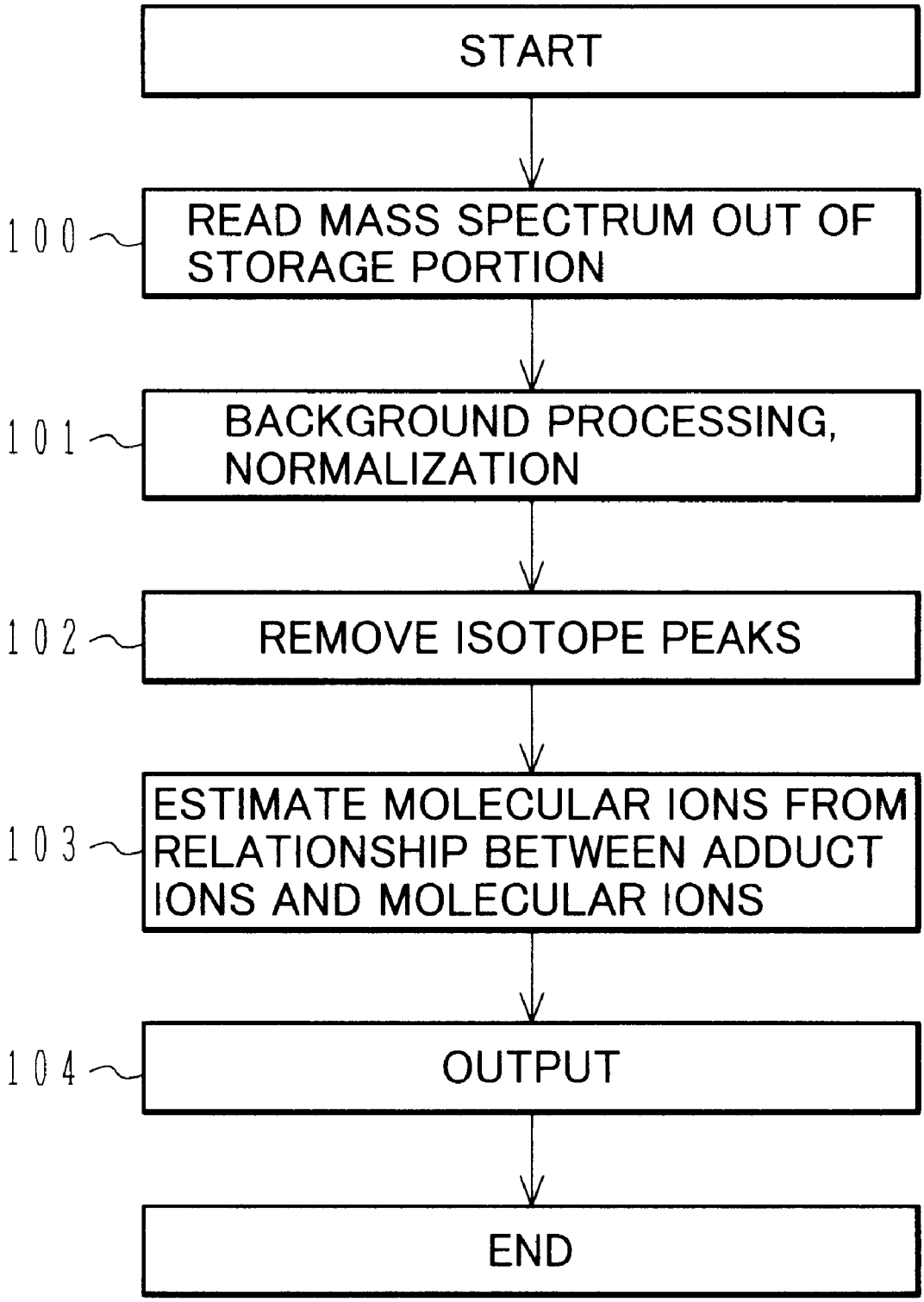
FIG. 2 is a flowchart showing overall operation of analyzing a mass spectrum executed by a data processor in FIG. 1.

FIG. 2 is a flowchart showing overall operation of analyzing a mass spectrum executed by the aforesaid data processor 6.

In step 100 of FIG. 2, the analyzing portion 62 reads a mass spectrum out of the mass spectrum storage portion 61.

Then, in step 101, the analyzing portion 62 carries out background processing and normalization.

Usually, spectrum of solvent ions and impurity ions are mixed in a resulting mass spectrum. In particular, when the amount of a sample introduced to the mass spectrometer is small, an effect of background becomes noticeable. Since such an effect of background may cause an error in the subsequent process of analysis, a mass spectrum in the region where a mass peak corresponding to a target component does not appear is subtracted as a background spectrum from a mass spectrum in the region where the mass peak corresponding to the target component appears.

In the normalization, a mass peak of an ion showing the highest intensity is set to 100 and relative intensity is determined for each of other mass peaks. This makes it possible to compare a mass spectrum with any of other mass spectra regardless of the amount of a sample introduced to the mass spectrometer.

Further, an actual mass spectrum includes noise-induced peaks near the baseline. Those peaks become obstacles to the subsequent process of comparison and hence must be removed. To this end, a threshold level is set and only the peaks exceeding the threshold level are extracted to be used for the comparison, thus eliminating an effect of noises.

Next, in step 102, isotope peaks are removed.

Natural carbon contains about 1% of $^{13}C$ in itself. By removing a mass peak attributable to the carbon isotope from the mass spectrum, the accuracy of the subsequent process can be improved. If the number of carbon atoms constituting a target ion is known, the intensity of isotopes can be approximately determined by multiplying the intensity of the ion by the number of carbon atoms and then determining 1/100 of the resulting product. In general, however, the number of carbon atoms constituting the ion cannot be determined in advance.

Accordingly, the probable number of carbon atoms is estimated in step 102 through approximation below. The subsequent process of estimating quasi-molecular ions is proceeded based on the approximation.

Because of $^{13}C/^{12}C$ ratio being 0.01 (=1%), a contribution of natural $^{13}C$ isotopes, which are contained in a target ion having intensity of Im and mass of (m), to an ion having mass of (m+1) is approximately expressed by the following formula (1):

$$Im\times(m/14)\times0.01 \quad (1)$$

Therefore, intensity Im+1' of the ion having mass of (m+1), from which the contribution of the isotopes has been removed, is expressed by the following formula (2):

$$Im+1'=Im+1-Im\times(m/14)\times0.01 \quad (2)$$

Here, if Im+1'<0, it is assumed to be Im+1'=0.

Supposing now that the intensity of an ion having mass of 200 is 100 and the intensity of an ion having mass of 201 is 20, a contribution of isotopes contained in the ion having mass of 200 to the ion having mass of 201 can be determined by the following formula (3):

$$100\times(200/14)\times0.01=14.2 \quad (3)$$

Thus, about 14 of the mass peak intensity 20 of the ion having mass of 201 is regarded as an isotope peak of the ion having mass of 200. As a result, 20−14=6, i.e., intensity of 6, is regarded as the inherent intensity of the ion having mass of 201. Through the above step of removing isotope peaks, the mass spectrum shown in FIG. 3 turns into the simplified form shown in FIG. 4.

Subsequently, in step 104, the molecular ions, etc. estimated in step 103 are supplied to the display portion 64 such as a CRT or printer for outputting in the form of display or prints.

A detailed process of searching for quasi-molecular ions in the above-mentioned step 103 will now be described with reference to a flowchart of FIG. 5.

Figure 5:
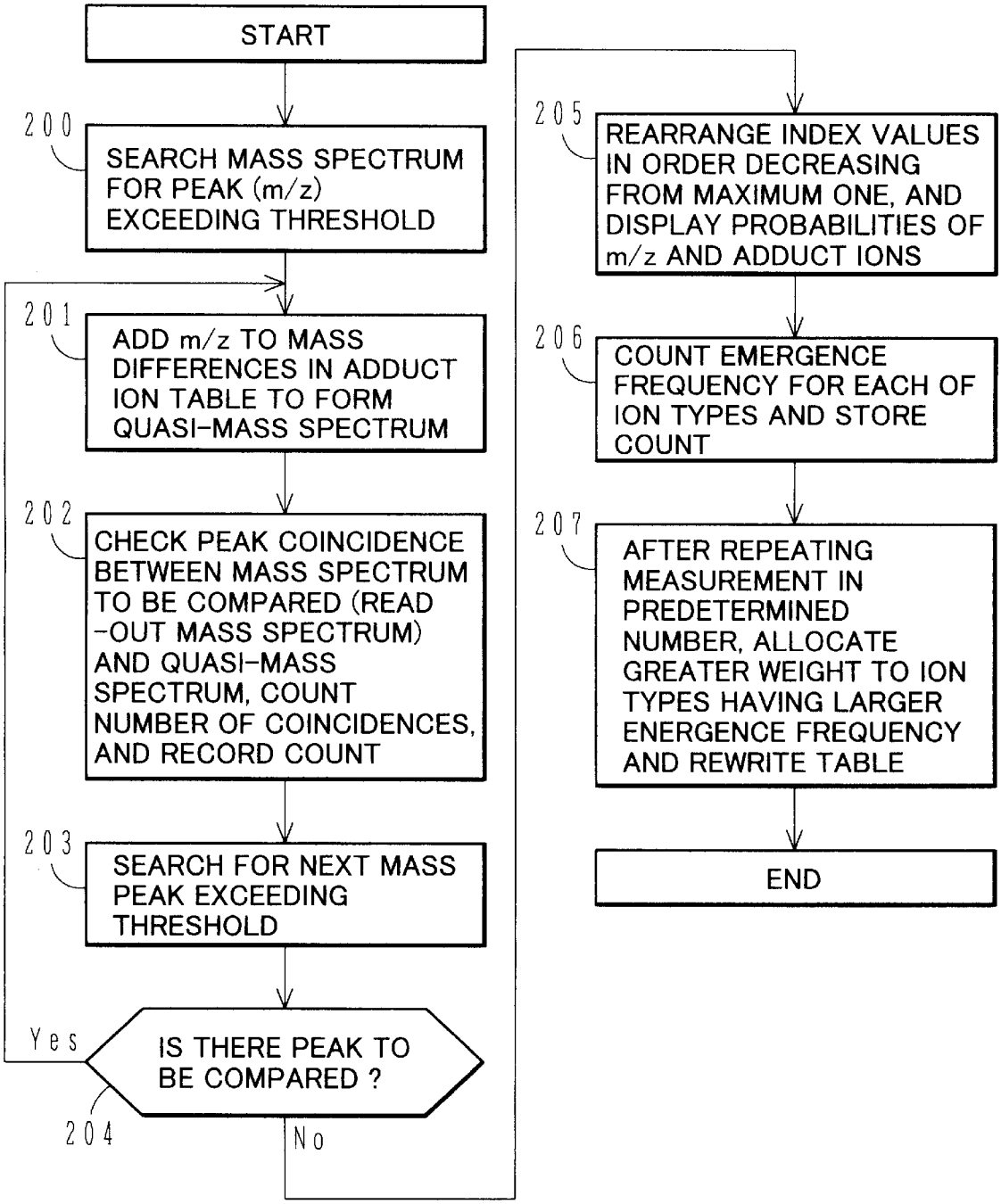
FIG. 5 is a flowchart showing a detailed process of searching for a quasi-molecular ion.

In step 200 of FIG. 5, the analyzing portion 62 searches the mass spectrum for a mass peak exceeding the threshold level. When such a mass peak is searched, the control flow proceeds to step 201.

In step 201, the analyzing portion 62 adds the mass of m/z corresponding to the searched peak to the mass differences listed in suitable one of the adduct ion tables (such as Tables 1 and 2 mentioned above) stored in the table 63, thereby forming a quasi-mass spectrum. Then, in step 202, the analyzing portion 62 compares the formed quasi-mass spectrum (without ion intensity) with the read-out mass spectrum in terms of mass. If agreement in mass between both the spectra is found, an index S is incremented by one and finally a total value of the index S is calculated.

Next, in step 203, the analyzing portion 62 searches for another mass peak exceeding the threshold level. If a mass peak to be compared is found in step 204, then the control flow goes back to step 201, followed by executing again the above-mentioned steps 201 to 203. If no mass peak to be compared is found in step 204, then the control flow proceeds to step 205.

In step 205, the analyzing portion 62 compares resulting values of the indexes S with each other, rearranges the index values in decreasing order from the maximum one, and outputs probabilities of m/z and adduct ions to the display portion 64 such as a CRT or printer.

Subsequently, in step 206, emergence frequency is counted for each of the ion types detected in the above-stated process, and stored in storage means or the like inside the analyzing portion 62. After that, in step 207, if the measurement is executed in a predetermined number of times, then a greater weight is allocated to the ion types having larger counted emergence frequency, followed by rewriting the adduct ion table stored in the table 63. The searching process is thus ended.

As a result of the weighting in the above-mentioned steps 206 and 207, a weight value allocated to the ion type for which mass agreement has been found is added to the index S in step 202. The added weight value is set, for example, such that assuming the normal ion type to be given 1, it is 1.5 or so for the ion type having high emergence frequency.

Thus, the ion types having high emergence frequency are automatically weighted and the adduct ion table is updated accordingly, resulting in improved accuracy of mass spectrometry for the objects which are analyzed in many times by individual mass spectrum measuring/analyzing apparatus.

With the first embodiment of the present invention, as explained above, since a molecular ion is automatically estimated by the data processor, it is possible to realize a method and apparatus for measuring and analyzing a mass spectrum by which a quasi-molecular ion and hence the molecular weight of a sample can be quickly estimated with high accuracy while preventing an error from being mixed in the process of analysis.

Further, with the first embodiment of the present invention, since the ion types having high emergence frequency are automatically weighted and the adduct ion table is automatically updated, it is possible to improve the accuracy of mass spectrometry for the objects which are analyzed in many times by individual mass spectrum measuring/analyzing apparatus.

Figure 6:
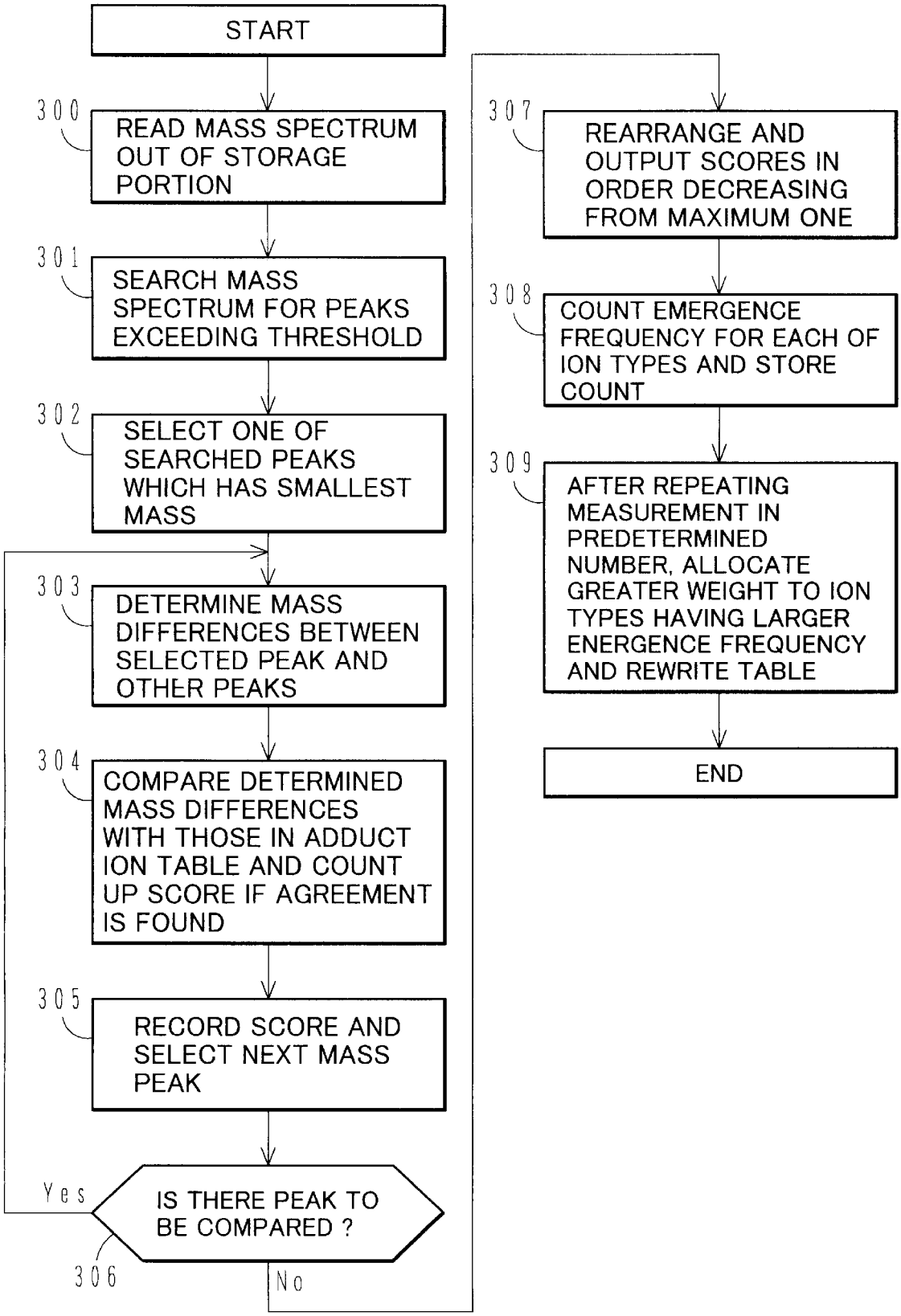
FIG. 6 is a flowchart showing operation based on a mass spectrum measuring/analyzing method according to a second embodiment of the present invention.

FIG. 6 is a flowchart showing operation based on a mass spectrum measuring/analyzing method according to a second embodiment of the present invention. A mass spectrum measuring/analyzing apparatus for implementing the mass spectrum measuring/analyzing method according to the second embodiment has the same construction as in the above first embodiment, and hence is neither illustrated nor described here.

The second embodiment differs from the above first embodiment in determining the index from direct comparison of the mass differences.

In step 300 of FIG. 6, the analyzing portion 62 reads a mass spectrum out of the mass spectrum storage portion 61. It is here assumed that a mass spectrum resulted after detracting a background spectrum from the read-out mass spectrum is as shown in FIG. 3.

Figure 4:
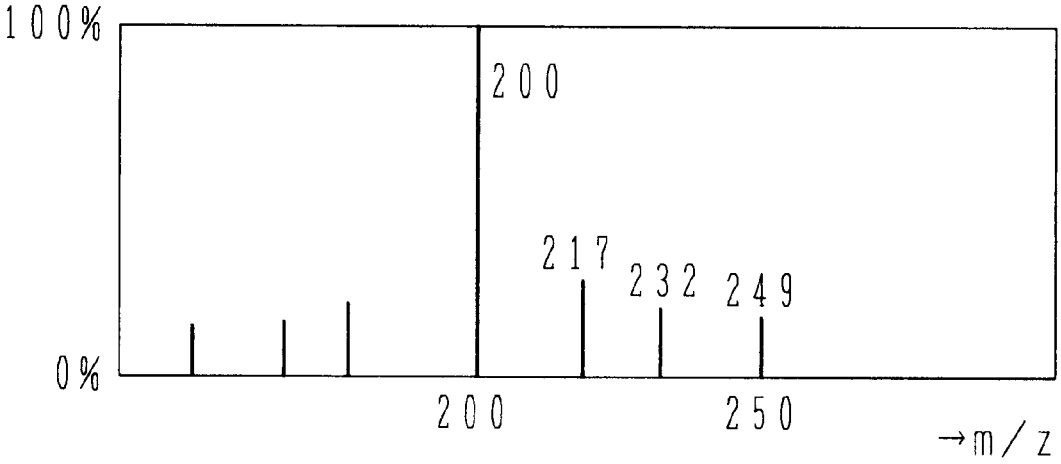
FIG. 4 is a graph showing a mass spectrum obtained after threshold processing and isotope processing.

Then, the mass spectrum of FIG. 3 is subjected to isotope processing, thereby obtaining a mass spectrum shown in FIG. 4. After that, in step 301, mass peaks exceeding a predetermined threshold level are searched from the read-out mass spectrum. In the example of FIG. 4, the searched peaks correspond to masses of 200, 217, 232 and 249.

Next, in step 302, one of the searched peaks which has the smallest mass is selected. In this case, the selected peak has mass of 200. Then, in step 303, mass differences between the mass of 200 corresponding to the selected peak and the masses (i.e., 217, 232 and 249) corresponding to the other searched peaks are calculated. In this case, 17, 32 and 49 are calculated.

Subsequently, in step 304, the analyzing portion 62 compares the calculated mass differences with those in the adduct ion table stored in the table 63, and counts up a score (index S) if agreement is found between both the mass differences. In this connection, when ionization is APCI and a measured ion is a positive ion, the above-mentioned Table 1 is used as the adduct ion table.

Whether the above three mass differences are present in Table 1 or not is checked, and if they are found in Table 1, then the index S is incremented by one. In this case, since agreement is found for all the three mass differences, the index S is given 3.

The score, i.e., the resulting index S, is stored in step 305, followed by selecting the next mass peak. In this case, the mass peak having the mass of 217 is selected. Then, it is determined in step 306 whether there is a peak to be compared or not.

In this case, since next peak having the mass of 217 remains and is to be compared with 200, 232 and 249, the control flow goes back to step 303. In step 303, the mass differences between the mass of 217 and the masses of the other ions are determined. In this case, —17, 15 and 32 are calculated.

Subsequently, similarly to the above-mentioned step 304, the analyzing portion 62 compares the calculated mass differences with those in Table 1. In this case, since there is only one agreement therebetween, the index S is given 1. After that, the steps 305 and 306 are likewise executed by assuming the quasi-molecular ion next by next, determining the mass differences, and then calculating the index S.

Obtained results are shown in Table 3 below.

TABLE 3

| Assumed Quasi-Molecular Ion | Mass Difference | Index |
|---|---|---|
| 200 | 17, 32, 49 | 3 |
| 217 | −17, 15, 32 | 1 |
| 232 | −32, −15, 17 | 1 |
| 249 | −49, −32, −17 | 0 |

From the above results, it is estimated that the mass of 200 providing the index S=3 represents the quasi-molecular ion with the highest probability.

Then, in step 307, the scores (indexes S) are rearranged and output by the display portion 64 in order decreasing from the highest score. Subsequent steps 308, 309 are the same as the above-mentioned steps 206, 207 shown in FIG. 5, and hence are not described here.

The above-explained example represents the process of estimating a molecular ion from the mass spectrum shown in FIG. 4. The process of estimating a molecular ion from a mass spectrum shown in FIG. 7 will now be described.

Figure 7:
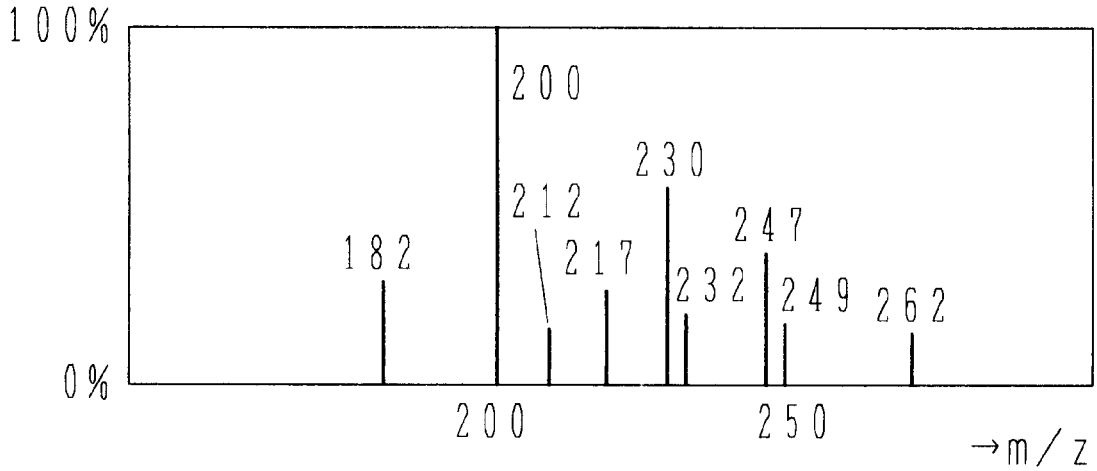
FIG. 7 is a graph showing a mass spectrum of a mixture.

The mass spectrum shown in FIG. 7 is a mass spectrum of a mixture. Therefore, many ions appear on one mass spectrum. In this case, selected mass peaks correspond to masses of 182, 200, 212, 217, 230, 232, 247 and 262. For each of the selected peaks, the index S is determined in accordance with the similar process as explained above. Obtained results are listed in Table 4 below.

TABLE 4

| No. | Assumed Quasi-Molecular Ion | Mass Difference | Index |
|---|---|---|---|
| 1 | 182 | 18, 30, 35, 48, 50 65, 80 | 0 |
| 2 | 200 | −18, 12, 17, 30 32, 47, 62 | 3 |
| 3 | 212 | −30, −12, 5, 18 20, 35, 50 | 0 |
| 4 | 217 | −35, −17, −5, 13 15, 30, 45 | 0 |
| 5 | 230 | −48, −30, −18, −13, 2, 17, 32 | 3 |
| 6 | 232 | −50, −32, −20 −15, −2, 15, 30 | 0 |
| 7 | 247 | −65, −47, −35, −30, −17, −15, 15 | 0 |
| 8 | 262 | −80, −62, −50, −45, −32, −30, −15 | 0 |

As seen from the above results, the assumed quasi-molecule ions represented by No. 2 and No. 5 show the same index value of 3. In this case, it is therefore estimated that two components corresponding to the quasi-molecule ions having the masses of 200 and 230 are mixed with each other.

Thus, even with a sample being a mixture, quasi-molecule ions can be exactly estimated by using the process explained above.

In addition to the above adduct ion tables, the table 63 also stores therein an APCI/ESI negative-ion adduct ion table below.

TABLE 5

APCI/ESI Negative-Ion Adduct Ion Table

| Mass Difference | Ion Type | |
|---|---|---|
| 0 | proton dissociated ion | M − 1 |
| +32 | methanol adduct | |
| +35 | chlorine adduct | |
| +60 | acetic acid adduct | $M + CH_3CO_2^-$ |

The above-stated adduct ion tables are selectively used depending on the ionization mode (whether the mode is ESI or APCI) and whether adduct ions are positive or negative ions. Since the data processor directly coupled to the mass spectrometer can understand in which analyzing mode read-out data is measured, selection of suitable one of the tables can be made automatically. Of course, suitable one of the tables stored in the table 63 may be selected with external input means such as a keyboard.

Further, the table arrangement may be modified such that plural mass differences between a quasi-molecular ion and a plurality of adduct ion types are stored in a plurality of storage tables divided in accordance with the kind of solvent used in mass spectrometry, the ionization mode and the polarity of spectrum, and suitable one of the storage tables is selected by the analyzing portion 62 depending on the analyzing conditions of the mass spectrometry.

The above-explained second embodiment of the present invention can also provide similar advantages as with the first embodiment.

The aspect of adduct ions may vary depending on the kind of compound and the analyzing conditions. In such a case, if quasi-molecular ions can be specified by a research worker as a result of analyzing measured data, the research worker can transfer those quasi-molecular ions to a memory in the data processor and form an adduct ion table specific to the individual worker.

While the index indicative of similarly between mass peaks has been calculated above by simply counting up the index for the peaks exceeding the threshold level without considering ion intensity at all, the ion intensity can be utilized as a weight applied when counting up the index.

Further, the ion intensity is not also taken into account in the adduct ion tables explained above. In view of that many spectra have already been measured, however, it is possible to sum up those spectra, determine average patterns thereof, and store the average patterns in the form of a table. In such a case, average values of the intensities of ions in two spectra (i.e., table and measured spectrum) to be compared with each other may be used as respective weights.

After estimating molecular ions as mentioned above, the results may be displayed in the display portion 64 such as a CRT in the form of a table in combination with a bar graph.

Figure 8:
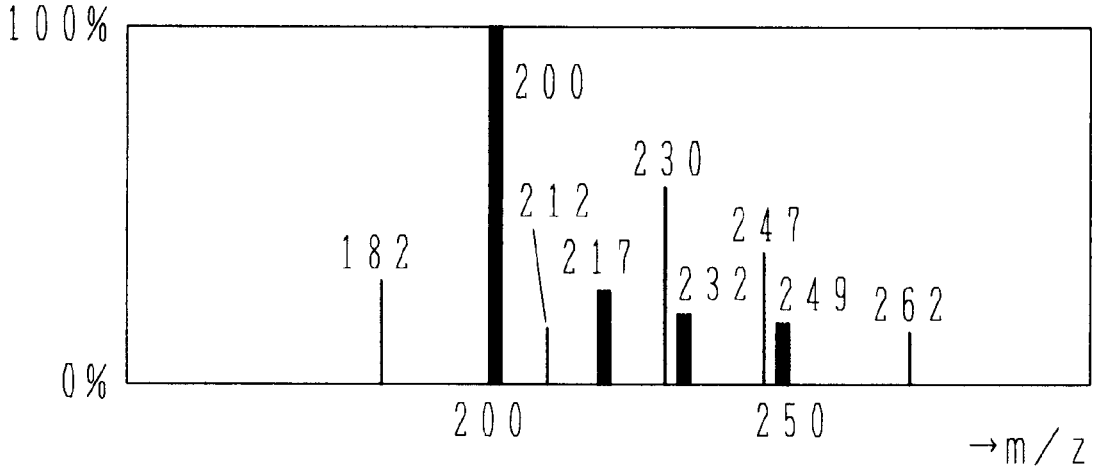
FIG. 8 is a bar graph in which a quasi-molecular ion and adduct ions are indicated by mass peaks wider than other mass peaks.

Also, the quasi-molecular ions can be more clearly indicated by representing one quasi-molecular ion and associated adduct ions in wider bars than used for other mass peaks, as shown in FIG. 8, so that the relation between the quasi-molecular ions and the adduct ions are easily noticeable from the bar graph.

Alternatively, a group of one quasi-molecular ion and associated adduct ions may be indicated by bars in the same color, and another group of another quasi-molecular ion and associated adduct ions may be indicated by bars in the same but different color from the above color. It is thus essential that the quasi-molecular ions are clearly indicated on the graph. This enables the sample situation or the measured results to be grasped more intuitively when the sample is a mixture.

The present invention constructed as explained above can provide advantages as follows. Since a molecular ion is automatically estimated by the data processor, it is possible to realize a method and apparatus for measuring and analyzing a mass spectrum by which a quasi-molecular ion and hence the molecular weight of a sample can be quickly estimated with high accuracy while preventing an error from being mixed in the process of analysis.

Further, since, the ion types having high emergence frequency are automatically weighted and the adduct ion table is automatically updated, it is possible to improve the accuracy of mass spectrometry for the objects which are analyzed in many times by individual mass spectrum measuring/analyzing apparatus.

Also, estimation of the quasi-molecular ion and hence estimation of the molecular weight can be performed regardless of experiences of an analyzing person. In addition, since a combination of plural compounds can be estimated even for a mixture, errors in the analysis and waste of time can be avoided.

What is claimed is:

1. A method of measuring and analyzing a mass spectrum in which an ion is created under the atmospheric pressure or thereabout, the created ion is introduced for mass spectrometry, and a resulting mass spectrum is processed and analyzed, the method comprising the steps of:

determining an index indicating how many times mass differences between the mass selected from said resulting mass spectrum and other masses agree with plural mass differences between a quasi-molecular ion and a plurality of adduct ion types stored in adduct ion storage means beforehand, and estimating, based on index values determined for respective selected masses, the ion providing a maximum value of said index indicating agreement of the mass difference as a quasi-molecular ion.

2. A method of measuring and analyzing a mass spectrum according to claim 1, further comprising the steps of storing adduct ions associated with the estimated quasi-molecular ion for each cycle of mass spectrometry, determining emergence frequency for each of the stored adduct ions after repeating the mass spectrometry in a predetermined number of times, allocating weights to said plurality of adduct ion types depending on respective determined emergence frequencies, storing the weights in said adduct ion storage means, and adding the stored weights to said index values in the step of estimating a quasi-molecular ion.

3. A method of measuring and analyzing a mass spectrum according to claim 1, wherein said resulting mass spectrum is a mass spectrum obtained by subtracting a background spectrum given as a mass spectrum in the region where a component to be analyzed does not appear from a mass spectrum resulted by mass spectrometry.

4. A method of measuring and analyzing a mass spectrum according to claim 1, wherein said adduct ion storage means stores plural mass differences between a quasi-molecular ion and a plurality of adduct ion types in a plurality of storage tables divided in accordance with the kind of solvent used in mass spectrometry, the ionization mode and the polarity of spectrum, and suitable one of said storage tables is selected depending on analyzing conditions of the mass spectrometry.

5. A method of measuring and analyzing a mass spectrum according to claim 1, wherein said resulting mass spectrum is a mass spectrum obtained by correcting a contribution of $^{13}C$ on a mass spectrum resulted by mass spectrometry.

6. A method of measuring and analyzing a mass spectrum according to claim 1, wherein said mass spectrum is represented in the form of a bar graph, and bars of said bar graph corresponding to mass peaks estimated to be representative of a quasi-molecular ion and associated adduct ions are indicated in clearly different width or color from other bars of said bar graph corresponding to mass peaks other than the estimated mass peaks.

7. An apparatus for measuring and analyzing a mass spectrum, comprising means for creating an ion under the atmospheric pressure or thereabout, a mass spectrometer to which the created ion is introduced for mass spectrometry, and data precessing means for processing and analyzing a mass spectrum output from said mass spectrometer, said data precessing means comprising adduct ion storage means for storing plural mass differences between a quasi-molecular ion and a plurality of adduct ion types, and an analyzing portion for determining an index indicating how many times mass differences between the mass selected from said output mass spectrum and other masses agree with the plural mass differences stored in said adduct ion storage means, and estimating, based on index values determined for respective selected masses, the ion providing a maximum value of said index indicating agreement of the mass difference as a quasi-molecular ion.

8. An apparatus for measuring and analyzing a mass spectrum according to claim 7, wherein said analyzing portion stores adduct ions associated with the estimated quasi-molecular ion for each cycle of mass spectrometry, determines emergence frequency for each of the stored adduct ions after repeating the mass spectrometry in a predetermined number of times, allocates weights to said plurality of adduct ion types depending on respective determined emergence frequencies, stores the weights in said adduct ion storage means, and adds the stored weights to said index values in estimating a quasi-molecular ion.

9. An apparatus for measuring and analyzing a mass spectrum according to claim 7, wherein said data processing means subtracts a background spectrum given as a mass spectrum in the region where a component to be analyzed does not appear from the mass spectrum output from said mass spectrometer, and said analyzing portion estimates a quasi-molecular ion based on a mass spectrum resulted from said subtraction.

10. An apparatus for measuring and analyzing a mass spectrum according to claim 7, wherein said adduct ion storage means stores plural mass differences between a quasi-molecular ion and a plurality of adduct ion types in a plurality of storage tables divided in accordance with the kind of solvent used in mass spectrometry, the ionization mode and the polarity of spectrum, and said analyzing portion selects suitable one of said storage tables depending on analyzing conditions of the mass spectrometry.

11. An apparatus for measuring and analyzing a mass spectrum according to claim 7, wherein said data processing means corrects a contribution of $^{13}C$ on the mass spectrum output from said mass spectrometer, and said analyzing portion estimates a quasi-molecular ion based on a corrected mass spectrum.

12. An apparatus for measuring and analyzing a mass spectrum according to claim 7, wherein said data processing means further comprises a data display portion, said data display portion representing said mass spectrum in the form of a bar graph such that bars of said bar graph corresponding to mass peaks estimated to be representative of a quasi-molecular ion and associated adduct ions are indicated in clearly different width or color from other bars of said bar graph corresponding to mass peaks other than the estimated mass peaks.

13. A method of measuring and analyzing a mass spectrum, comprising the steps of determining mass differences between a particular peak and a plurality of other peaks, determining an index value by comparing said mass differences with values stored in a storage table, determining mass differences between another peak different from said particular peak and a plurality of peaks different from said another peak, determining an index value by comparing said mass differences with the values stored in said storage table, and selecting particular one of said plurality of peaks by comparing the index values determined respective for said plurality of peaks with each other.

14. An apparatus for measuring and analyzing a mass spectrum, comprising a storage table for storing mass differences therein and a processing unit for executing calculation based on a plurality of peaks to select a particular peak, wherein said processing unit determines mass differences between a particular peak and a plurality of other peaks, determines an index value by comparing said mass differences with values stored in said storage table, determines mass differences between another peak different from said particular peak and a plurality of peaks different from said another peak, determines an index value by comparing said mass differences with the values stored in said storage table, and selects particular one of said plurality of peaks by comparing the index values determined respective for said plurality of peaks with each other.

* * * * *